US009896900B2

(12) United States Patent
Clarke

(10) Patent No.: US 9,896,900 B2
(45) Date of Patent: Feb. 20, 2018

(54) SEALING APPARATUS

(75) Inventor: Tim Clarke, Aberdeen (GB)

(73) Assignee: RUBBERATKINS LIMITED, Bridge of Don, Aberdeen (GB)

( * ) Notice: Subject to any disclaimer, the term of this patent is extended or adjusted under 35 U.S.C. 154(b) by 1134 days.

(21) Appl. No.: 12/747,887

(22) PCT Filed: Dec. 10, 2008

(86) PCT No.: PCT/GB2008/004059

§ 371 (c)(1),
(2), (4) Date: Dec. 30, 2010

(87) PCT Pub. No.: WO2009/074785

PCT Pub. Date: Jun. 18, 2009

(65) Prior Publication Data

US 2011/0101615 A1 May 5, 2011

(30) Foreign Application Priority Data

Dec. 11, 2007 (GB) ..... 0724122.7

(51) Int. Cl.
*E21B 33/12* (2006.01)
*E21B 33/128* (2006.01)

(52) U.S. Cl.
CPC ..... *E21B 33/1216* (2013.01); *E21B 33/128* (2013.01)

(58) Field of Classification Search
CPC ..... E21B 33/1216; F16J 15/028
USPC ..... 277/644, 652, 653, 654, 411, 607, 603
See application file for complete search history.

(56) References Cited

U.S. PATENT DOCUMENTS 2,602,514 A * 7/1952 Althouse, Jr. ..... E21B 33/136 166/202
2,726,722 A * 12/1955 Baker ..... E21B 33/1216 166/196
2,836,252 A * 5/1958 Lane ..... E21B 33/12 166/196

(Continued)

FOREIGN PATENT DOCUMENTS

EP 1 197 632 4/2002
WO WO 2005/121498 12/2005
WO WO 2006/113338 A2 10/2006

OTHER PUBLICATIONS

PCT International Preliminary Report on Patentability and Written Opinion, PCT Application No. PCT/GB2008/004059, dated Jun. 15, 2010, eleven pages.

(Continued)

*Primary Examiner* — Kristina R Fulton
*Assistant Examiner* — L. Susmitha Koneru
(74) *Attorney, Agent, or Firm* — Fenwick & West LLP

(57) ABSTRACT

A sealing apparatus for sealing a well bore is described. The sealing apparatus comprises a sealing element adapted to be moved from a run-in configuration to a set configuration, a first back-up layer and at least one second back-up layer sandwiched between the sealing element and the first back-up layer. The at least one second back-up layer comprises a thinner material than the first back-up layer. The first back-up layer and the at least one second back-up layer are adapted to be moved from the run-in configuration to the set configuration under the action of the sealing element.

36 Claims, 13 Drawing Sheets

(56) References Cited

U.S. PATENT DOCUMENTS 2,885,009 A * 5/1959 Baker ..... E21B 33/1216 277/337
3,382,014 A * 5/1968 Marley ..... F16C 17/024 384/106
3,822,067 A * 7/1974 Berry ..... E21B 37/10 277/335
3,955,625 A * 5/1976 Hughes ..... E21B 33/136 166/202
4,137,970 A 2/1979 Laflin et al.
4,457,489 A * 7/1984 Gilmore ..... F16L 37/28 137/596.18
5,010,958 A 4/1991 Meek et al.
5,833,369 A * 11/1998 Heshmat ..... F16C 17/042 384/105
5,904,351 A * 5/1999 Masek ..... B41F 13/08 271/277
6,318,461 B1 11/2001 Carisella
6,443,458 B1 * 9/2002 Jansch ..... G01M 3/022 277/335
6,640,503 B1 * 11/2003 Evensen ..... E04F 11/1812 277/602
6,708,979 B2 * 3/2004 Stratman ..... B62D 25/24 220/359.4
7,004,248 B2 * 2/2006 Hoffman ..... E21B 33/124 166/188
7,261,300 B2 * 8/2007 Agrawal ..... F16J 15/3432 277/399
7,331,612 B2 * 2/2008 Frost ..... F16L 19/02 277/644
7,997,858 B2 * 8/2011 Mikulec ..... F16J 15/164 277/411
2002/0043368 A1 * 4/2002 Bell ..... E21B 33/1216 166/118
2004/0055758 A1 * 3/2004 Brezinski ..... E21B 33/12 166/384
2004/0069502 A1 * 4/2004 Luke ..... E21B 33/1208 166/387
2004/0182583 A1 * 9/2004 Doane ..... E21B 23/06 166/387
2005/0062237 A1 * 3/2005 Parker ..... F23R 3/60 277/654
2006/0289173 A1 12/2006 Conaway et al.
2007/0261863 A1 * 11/2007 MacLeod ..... E21B 33/1293 166/387
2012/0133098 A1 * 5/2012 Farquhar ..... E21B 33/128 277/314

OTHER PUBLICATIONS

PCT International Search Report, PCT Application No. PCT/GB2008/004059, dated Dec. 11, 2009, six pages.

* cited by examiner

SEALING APPARATUS

FIELD OF THE INVENTION

The present invention relates to an apparatus for sealing a well bore, particularly, but not exclusively, the present invention relates to a high temperature and/or expansion sealing apparatus.

BACKGROUND TO THE INVENTION

In many downhole environments, packers or similar sealing devices are used to seal sections of the well bore so that, for example, hydrocarbons can be extracted from a well bore section into the production tube without leakage up or down the annulus between the well bore surface and the production tube.

Elastomeric seal elements are widely used in conventional packers as they are relatively easy to manipulate and have good sealing properties once engaged with a well bore surface. A conventional packer is also often provided with one or more seal back-ups to prevent extrusion of the elastomeric sealing element in the annulus when the sealing apparatus is under pressure.

However, the mechanical properties of elastomers can deteriorate as pressure and/or temperature increases. The performance of these conventional packers are also affected when, in addition to the high pressure and/or high temperature environment, the seal has to seal across a large annulus. These high expansion seals are particularly vulnerable in the aggressive environments described.

There is a desire within the oil industry to operate in high temperature and high pressure environments, and there is need for a sealing apparatus which can operate successfully in these environments, particularly a high expansion sealing apparatus.

SUMMARY OF THE INVENTION

According to a first aspect of the present invention there is provided a sealing apparatus for sealing a well bore, the sealing apparatus comprising:

a sealing element adapted to be moved from a run-in configuration to a set configuration;

a first back-up layer; and at least one second back-up layer sandwiched between the sealing element and the first back-up layer, the first back-up layer and the at least one second back-up layer being adapted to be moved from the run-in configuration to the set configuration under the action of the sealing element;

wherein the at least one second back-up layer comprises a thinner material than the first back-up layer.

In one embodiment, providing a second back-up layer of a thinner material than the first back-up layer facilitates the expansion of the back-up system as the sealing element moves from the run-in configuration to the set configuration. This is of particular importance in environments in which sealing apparatus has to seal across a large annular gap. Furthermore, use of a thinner material which is easier to bend will result in a reduced level of stress being built up in the sealing element during deployment. This is advantageous because stress can have a detrimental effect on the mechanical properties of the element.

Preferably, the first and second back-up layers are annular.

Preferably, the first back-up layer comprises a slotted portion.

Preferably, the first back-up layer is slotted to form discrete petals. A back-up layer which is slotted to form "petals" can expand greater distances than a non-slotted layer and permits the material to expand without elongation. Furthermore, a slotted first back-up layer will expand more easily than a continuous layer resulting in lower stress levels in the sealing element. The second layer of the thinner material has further advantages with a slotted first back-up layer. As the first back-up layer expands, the slots open up and a thinner second back-up layer can form into the gaps between the first back-up layer petals to remove any clearances between the first and second back-up layers and any curvature mismatches between the first back-up layer and the bore wall. Removal of these clearances and mismatches is important, since the properties of some sealing elements, for example rubber elements, are very poor at very high temperatures, i.e. around 200° C. At this temperature, rubber can extrude through any clearances in the back-up layers or between the apparatus and the bore wall. The first back-up layer is the primary structural layer supporting the sealing element. The second back-up layer is provided to fill the gaps inbetween the petals of the first back-up layer and to resist extrusion of the sealing element, in use, between the apparatus and the well bore.

Preferably, the first back-up layer comprises a non-slotted portion.

Preferably, the first back-up layer comprises a deformable material.

In one embodiment the deformable material is ductile.

Preferably, in use, the first back-up layer, in the run-in configuration, is adapted to engage the bore wall. This permits the first back-up layer, in use, to be pinned to the well bore surface by friction once the sealing apparatus is set. This method of constraint removes any shear loading applied to the first back-up layer, which in turn allows for a thinner section to be used. A thinner section reduces the stress imparted into the sealing element as the sealing element moves into the set configuration, and once fully deployed.

Preferably, the first back-up layer comprises a bore engaging surface.

Preferably, in use, more than 50% of the bore engaging surface is, in use, engaged with the bore surface in the set configuration. Such an arrangement ensures that the axial load applied to the sealing element, in use, is not sufficient to overcome the radial load maintaining the sealing apparatus in contact with the bore wall.

Preferably, in use, more than 50% of the slotted portion surface is, in use, engaged with the bore surface in the set configuration.

Preferably, the bore engaging surface comprises relatively high friction co-efficient.

Preferably, the bore engaging surface defines a relatively high friction co-efficient surface profile.

Alternatively or additionally, the bore engaging surface comprises a coating of a relatively high friction coefficient material.

Preferably, the/each second back-up layer is a ductile material. Providing a ductile layer, which can form and adapt in shape, minimises the stress imparted to the seal element as the seal apparatus sets and is adapted to mould, when used with a slotted first back-up layer, into gaps between adjacent first back-up layer petals.

Preferably, the ductile material is stainless steel.

In one embodiment, the/each second back-up layer comprises a plurality of back-up layers.

Preferably, the first back-up layer has an upper edge.

Preferably, the first back-up layer upper edge is chamfered.

Preferably, the upper edge, in use, is chamfered towards the bore wall. A chamfered edge will more easily deform into a close engagement with the bore wall reducing the possibility of clearances between the first back-up layer and the bore wall opening up.

Preferably, where the first back-up layer defines discrete petals, each petal has side edges. By side edges it is meant edges which lie in a direction parallel to the longitudinal axis of the sealing apparatus.

Preferably, the side edges are chamfered.

Preferably, the side edges are, in use, chamfered towards the bore wall.

Preferably, the at least one second back-up layer has an upper edge.

Preferably, the at least one second back-up layer upper edge is chamfered.

Preferably, the at least one second back-up layer upper edge extends above the first back-up layer upper edge. As the second back-up layer is of a thinner material to the first back-up layer, the/each second back-up layer will more easily deform into engagement with the well bore surface, in use, closing any clearances between the apparatus and the well bore and to remove any mismatches between the apparatus and the bore internal diameter. The removal of clearances is important as, at high temperatures, sealing elements made of elastomeric materials can extrude through the clearances.

In an alternative embodiment, the first back-up layer upper edge extends above the at least one second back-up layer upper edge. As the side edges are less exposed than the upper edge, it is possible to make the edge of the side edge chamfers sharper as they are not as exposed as the upper edge. A sharp edge can form a tighter fit with the at least one second back-up layer minimising the possibility of clearances between the first back-up layer and the bore wall opening up.

Preferably, each of the plurality of second back-up layers comprises a slotted portion. Having slotted second back-up layers also provides for additional expansion. If the back-up layers are slotted, the provision of multiple second layer will ensure that gaps between the adjacent petals of the first back-up layer are filled.

In one embodiment, each of the second back-up layers comprises fewer slots than the first back-up layer.

Preferably, at least one second back-up layer has a sealing element engaging surface.

Preferably the/each sealing element engaging surface comprises a low friction coating. A low friction coating reduces the stresses imparted into the element material during deployment and under pressure.

Preferably, the first and second back-up layers deform under the action of the sealing element.

In one embodiment, the back-up layers plastically deform. Plastic deformation reduces the stresses imparted to the sealing element by the back-up layers once the sealing apparatus is set.

In an alternative embodiment, the back-up layers elastically deform. Elastic deformation allows the back-up layers to at least partially recover to the run-in configuration when it is desired to retrieve the sealing apparatus.

In one embodiment a first back-up layer upper portion is bent inwards towards a sealing apparatus longitudinal axis. Having the upper portion of the first back-up layer facing radially inwards, biases the first back-up layer to a run in configuration such that the first back-up layer at least partially recovers to the run-in configuration when it is desired to retrieve the sealing apparatus. Such an arrangement is most effective in an apparatus in which the first back-up layer upper edge extends above the at least one second back-up layer upper edges.

Preferably, the sealing apparatus further comprises a ring member.

Preferably, the ring member is attached to a lower portion of the first back-up layer. A ring member is provided to withstand the hoop stress imparted to the back-up layers by the differential pressure held by the sealing element.

Preferably, the ring member is separate to the first and second back-up layers. The use of a separate ring member to the first and second back-up layers means that the back-up layers can be of substantially constant cross-sections. The use of a constant cross-section material, particularly for the first back-up layer, helps reduce stress concentrations in the first back-up layer and enables a relatively thin section to be used. A thin section will bend more easily and will reduce the stress imparted into the sealing element.

Preferably, the first back-up layer lower portion is received within the ring member.

Preferably, the ring member is attached to the non-slotted portion of the first back-up layer.

Preferably, the interface between the slotted and non-slotted portions of the first back-up layer is received within the ring member.

Preferably, the ring member is connected to an external surface of the first back-up layer lower portion.

Preferably, the/each second back-up layer is connected to the ring member.

Preferably, the ring member defines a profiled surface.

Preferably, as the sealing apparatus moves from the run-in configuration to the set configuration, the first back-up layer bends around at least a portion of the profiled surface.

In one embodiment, at least a portion of the first back-up layer, in the run-in configuration is displaced from the ring member profiled surface.

Preferably, in this embodiment, the ring member profiled surface tapers axially away from the first back-up layer in the run-in configuration.

In one embodiment the first back-up layer comprises spring steel. Spring steel can be used to assist in returning the sealing apparatus to the run-in configuration when it is desired to recover the sealing apparatus from downhole.

The sealing element may comprise a packing element, a cup, an expandable element, a swellable element, an inflatable element or any suitable style of element.

Preferably, in the run-in configuration, the maximum diameter defined by the back-up layers is no more than the maximum diameter defined by the ring member.

Preferably, the sealing apparatus further comprises an intermediate layer between the first back-up layer and the/each second back-up layer.

Preferably the intermediate layer extends above and below a first back-up layer upper edge.

Preferably the intermediate layer comprises a strong flexible material.

Most preferably the intermediate layer comprises a woven steel mesh. Using a flexible layer such as a woven steel mesh further minimises the existence of gaps between the first and second back-up layers in the set configuration. The flexible material fills up any gaps which may exist between the first and second back up layers.

Preferably the intermediate layer is thinner than either or any of the first and second back-up layers.

In one embodiment the intermediate layer wraps over an upper edge of the/each second back-up layer.

In an alternative embodiment the intermediate layer wraps over the upper edge of the first back up layer.

According to a second aspect of the present invention, there is a sealing apparatus for sealing a well bore, the sealing apparatus comprising:

a seal element adapted to move from a run-in configuration to a set configuration;

at least one back-up layer, the/each back-up layer being adapted to be moved from the run-in configuration to the set configuration under the action of the sealing element; and a ring member;

wherein a portion of the/each back-up layer is received inside the ring member, the ring member and/each back-up layer being separate components.

Preferably, at least one of said back-up layers is of substantially constant cross-section.

According to a third aspect of the present invention, there is provided a sealing apparatus for sealing a well bore, the sealing apparatus comprising:

a seal element adapted to be moved from a run-in configuration to a set configuration; and at least one back-up layer, the/each back-up layer being adapted to be moved from the run-in configuration to the set configuration under the action of the sealing element;

wherein at least one of said back-up layers comprises a resilient material, said resilient material being biased to the run-in configuration.

According to a fourth aspect of the present invention there is provided a sealing apparatus for sealing a well bore, the sealing apparatus comprising:

a sealing element adapted to be moved from a run in configuration to a set configuration;

a first back-up layer;

at least one second back-up layer located between the sealing element and the first back-up layer, and an intermediate layer sandwiched between the first back-up layer and the at least one second back-up layer, the first back-up layer, the intermediate layer and at least one second back-up layer being adapted to be moved from the run-in configuration to the set configuration under the action of the sealing element.

It will be understood that features of one aspect may be equally applicable to the other aspects and are not listed for brevity.

BRIEF DESCRIPTION OF THE DRAWINGS

Embodiments of the present invention will now be described with reference to the accompanying drawings in which.

DETAILED DESCRIPTION OF THE DRAWINGS

Figure 1:
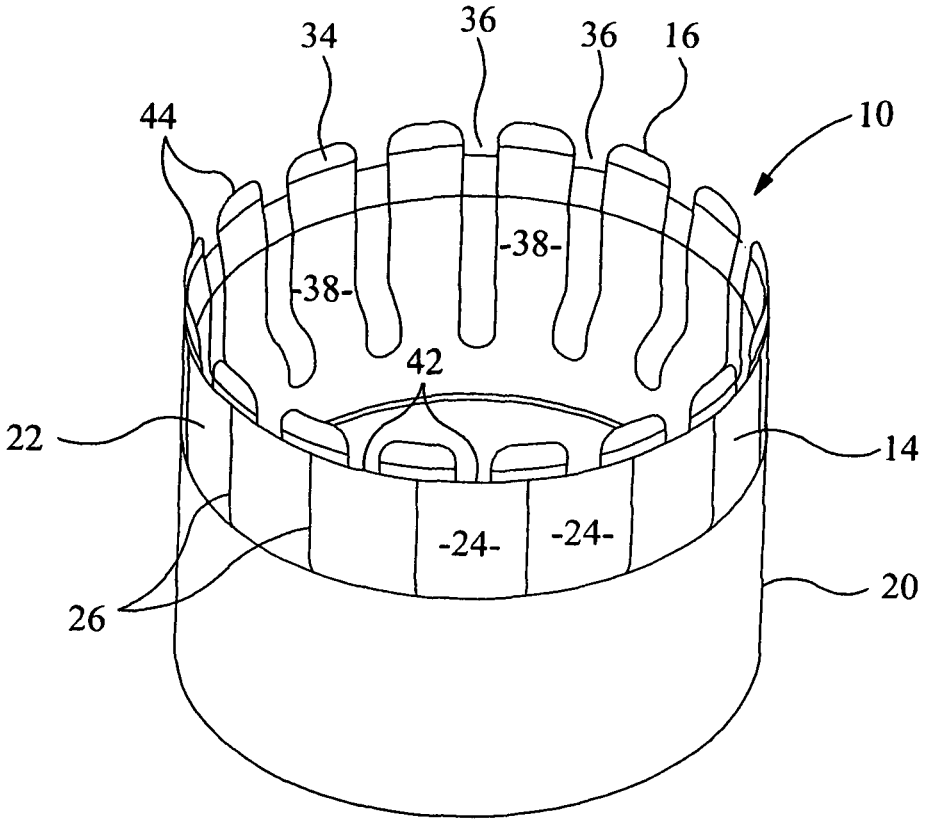
FIG. 1 is a perspective of a sealing apparatus in a run-in configuration according to a first embodiment of the present invention.
Figure 2:
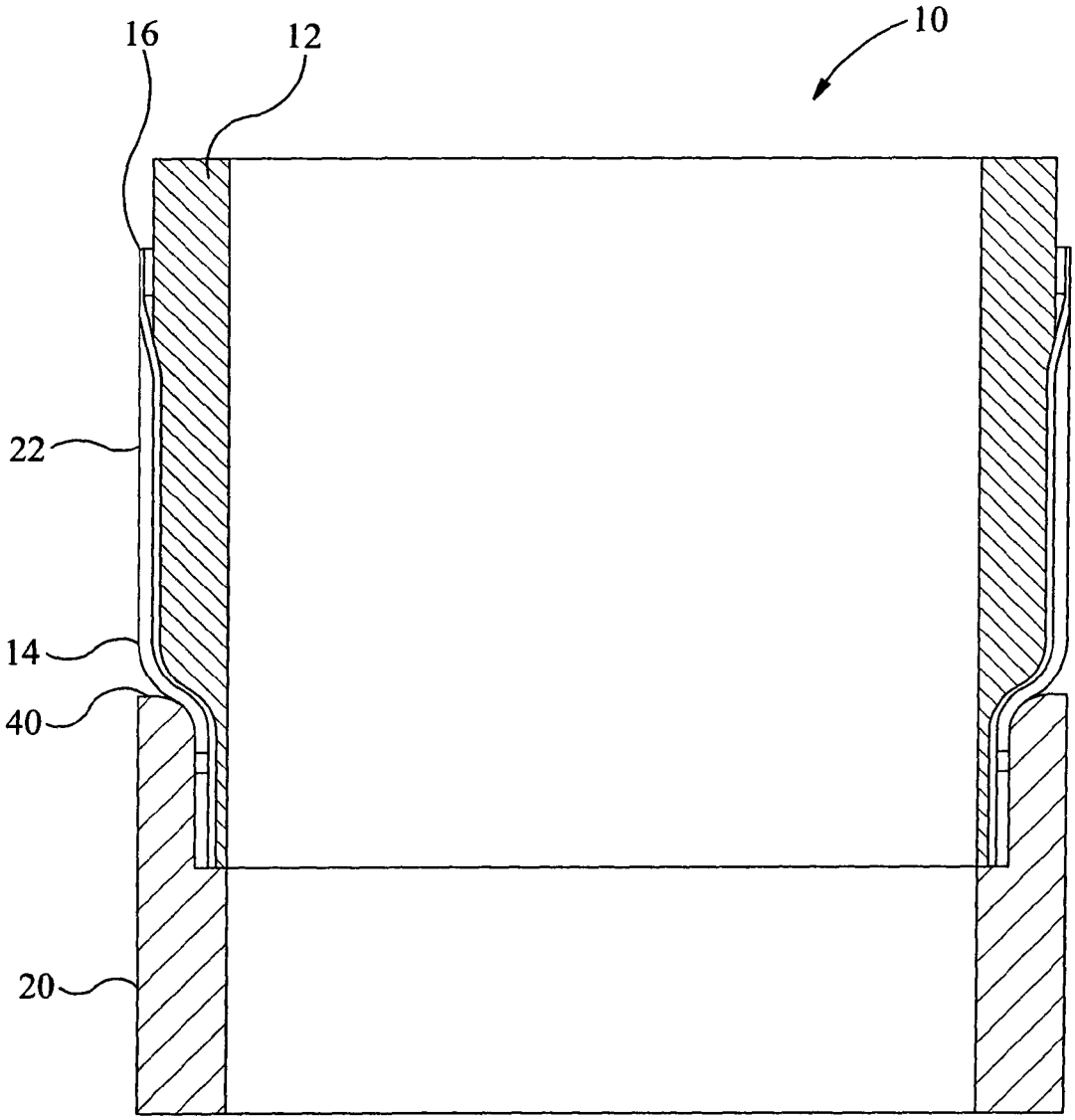
FIG. 2 is a section view of the apparatus of FIG. 1.
Figure 3:
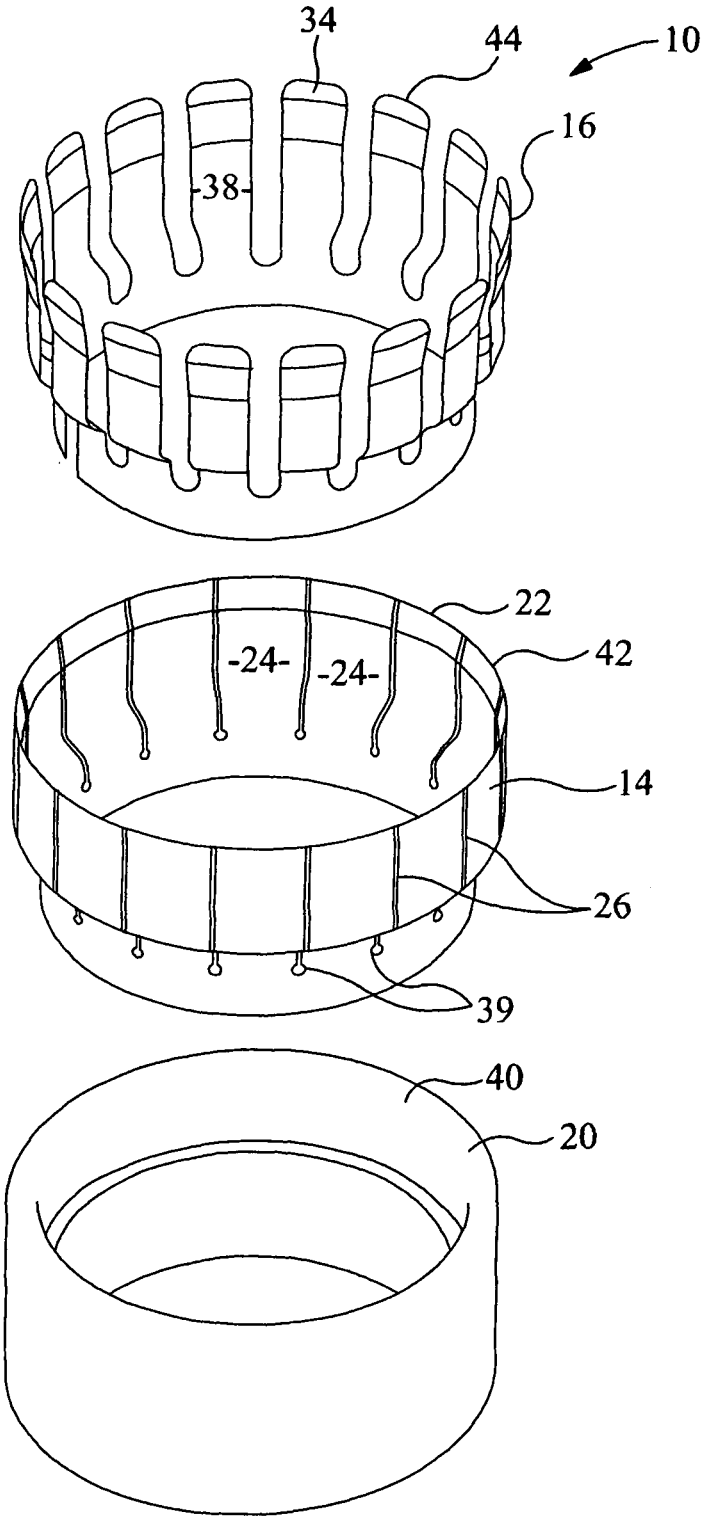
FIG. 3 is an exploded view of the apparatus of FIG. 1.

Reference is firstly made to FIGS. 1, 2 and 3 which show views of a sealing apparatus, generally indicated by reference numeral 10, in a run-in configuration according to a first embodiment of the present invention.

Figure 4:
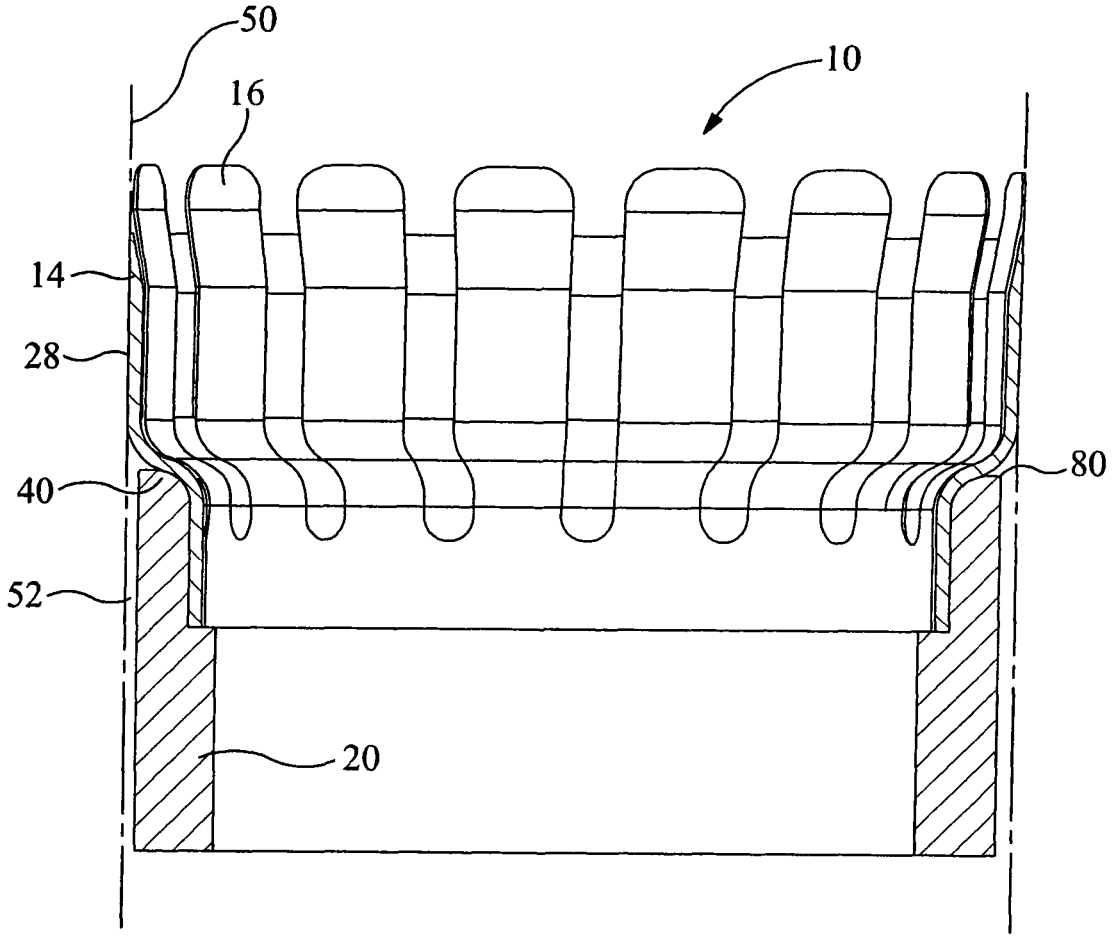
FIG. 4 is a section view of the apparatus of FIG. 1 in a set configuration.
Figure 5:
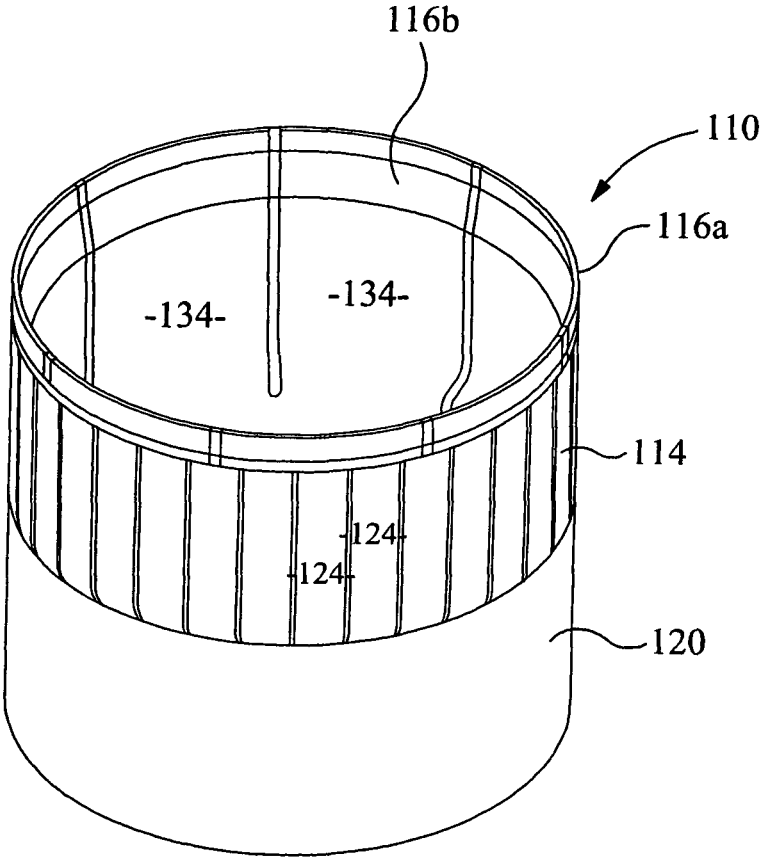
FIG. 5 is a perspective of a high expansion sealing apparatus in a run-in configuration according to a second embodiment of the present invention.
Figure 6:
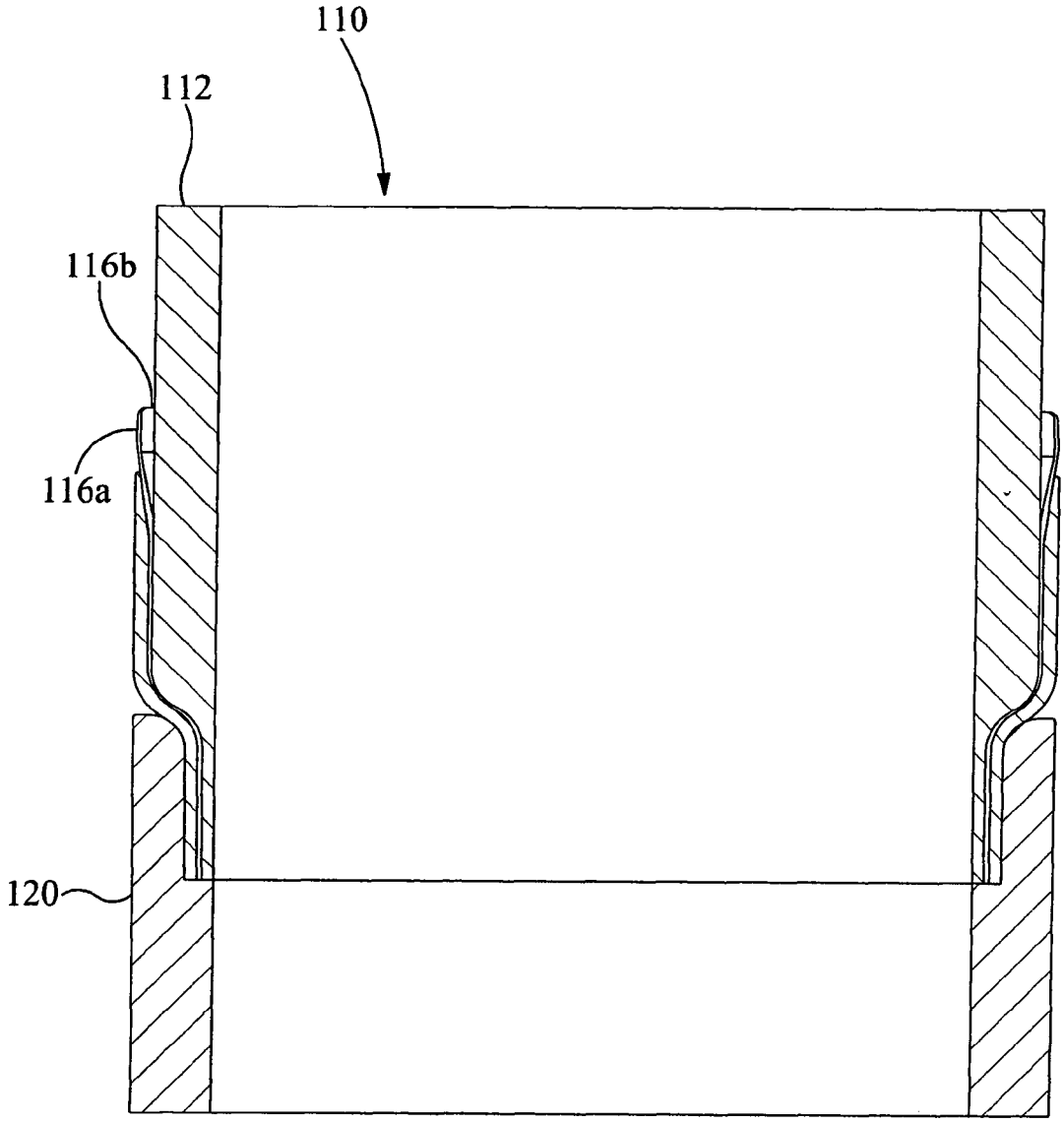
FIG. 6 is a section view of the apparatus of FIG. 5.
Figure 7:
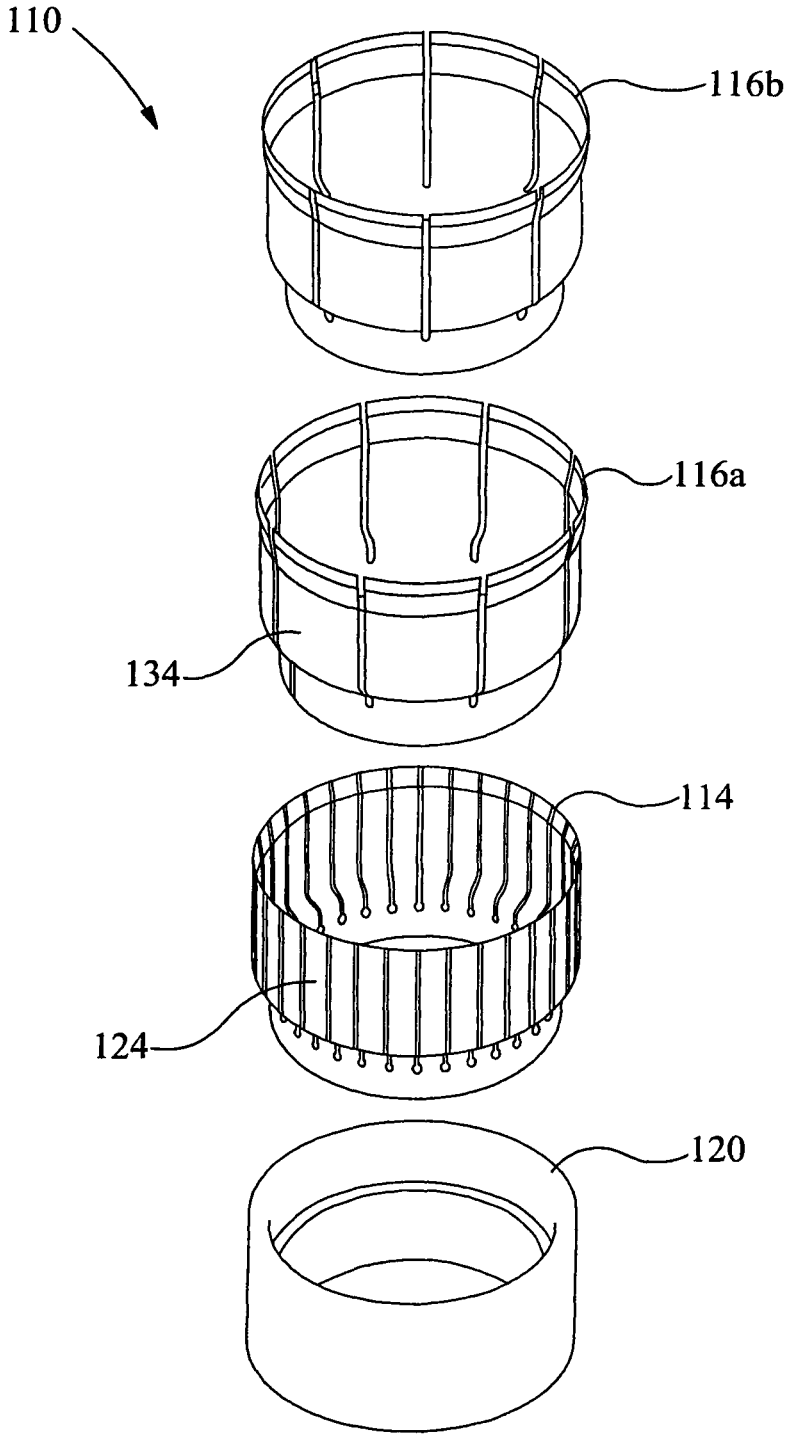
FIG. 7 is an exploded view of the apparatus of FIG. 5.
Figure 8:
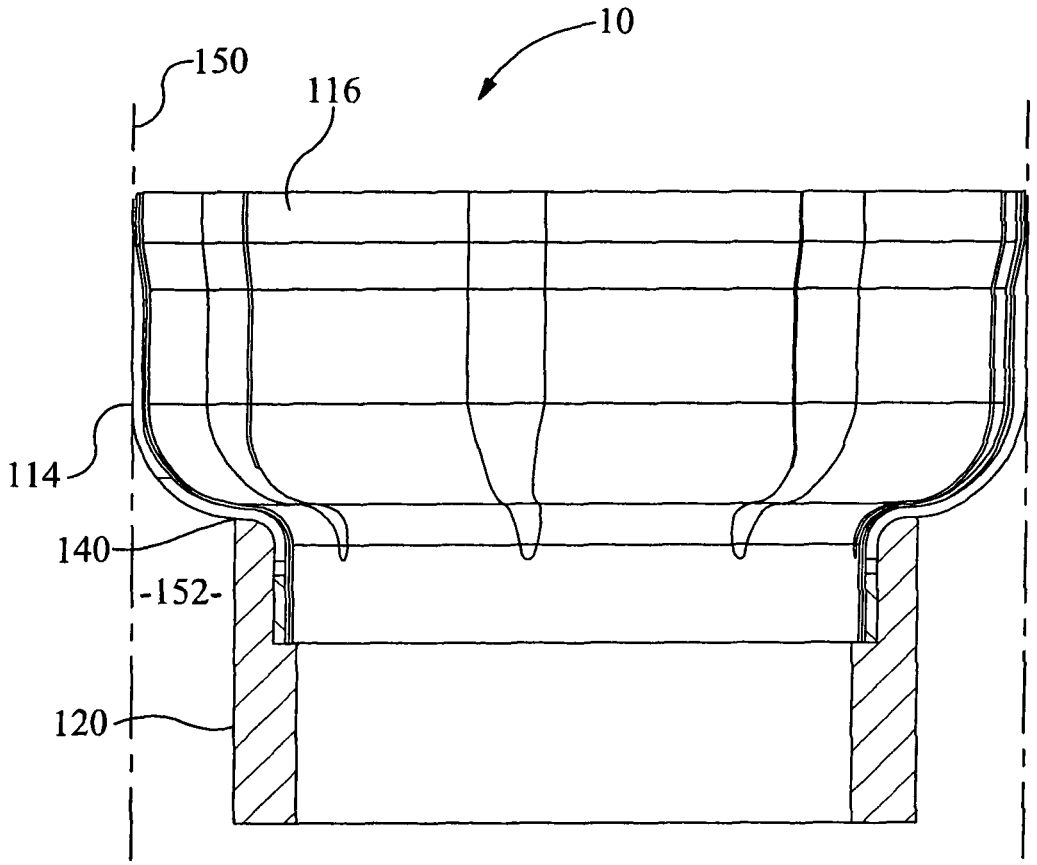
FIG. 8 is a section view of the apparatus of FIG. 5 in a set configuration.
Figure 9:
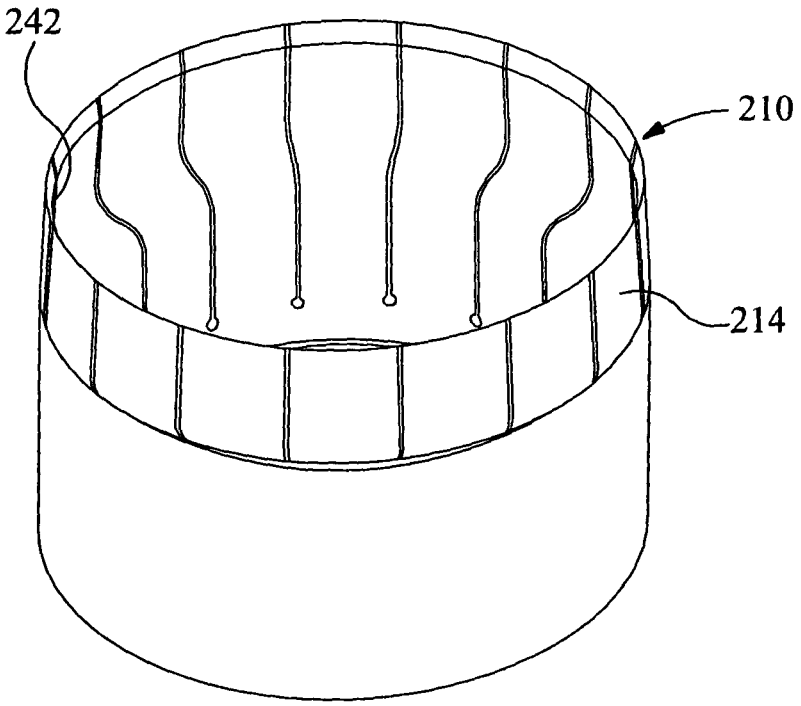
FIG. 9 is a perspective of a retrievable sealing apparatus in a run-in configuration according to a third embodiment of the present invention.
Figure 10:
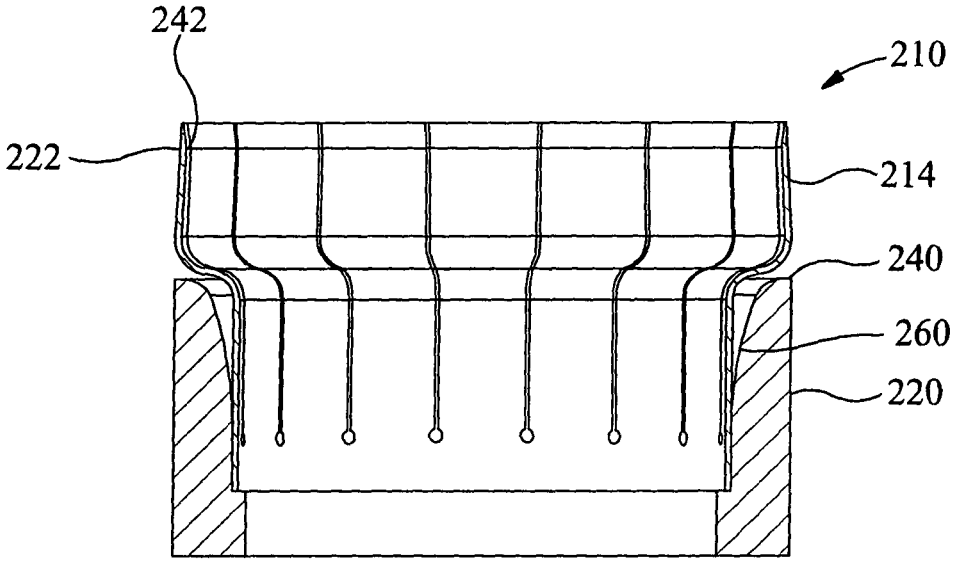
FIG. 10 is a section view of the apparatus of FIG. 9.
Figure 11:
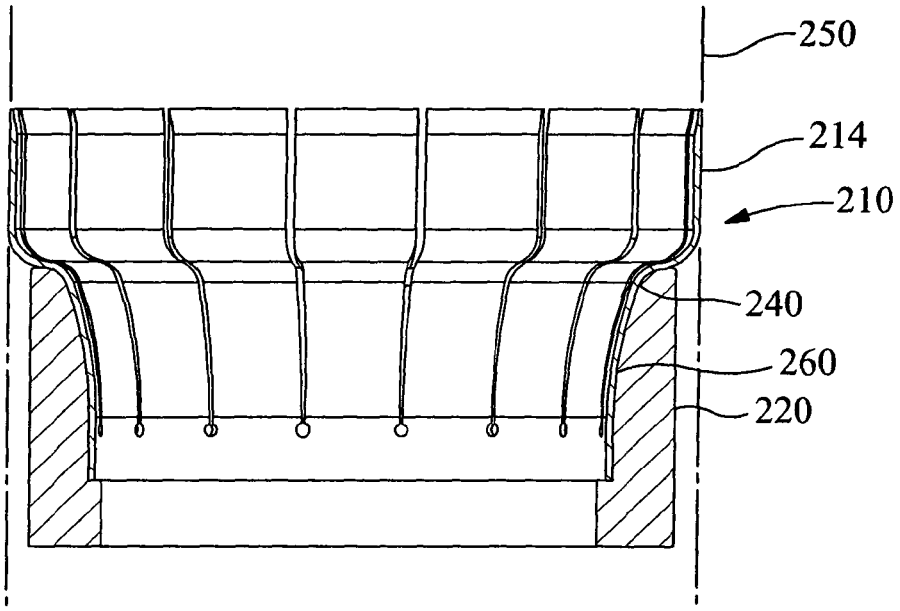
FIG. 11 is a section view of the apparatus of FIG. 9 in a set configuration.
Figure 12:
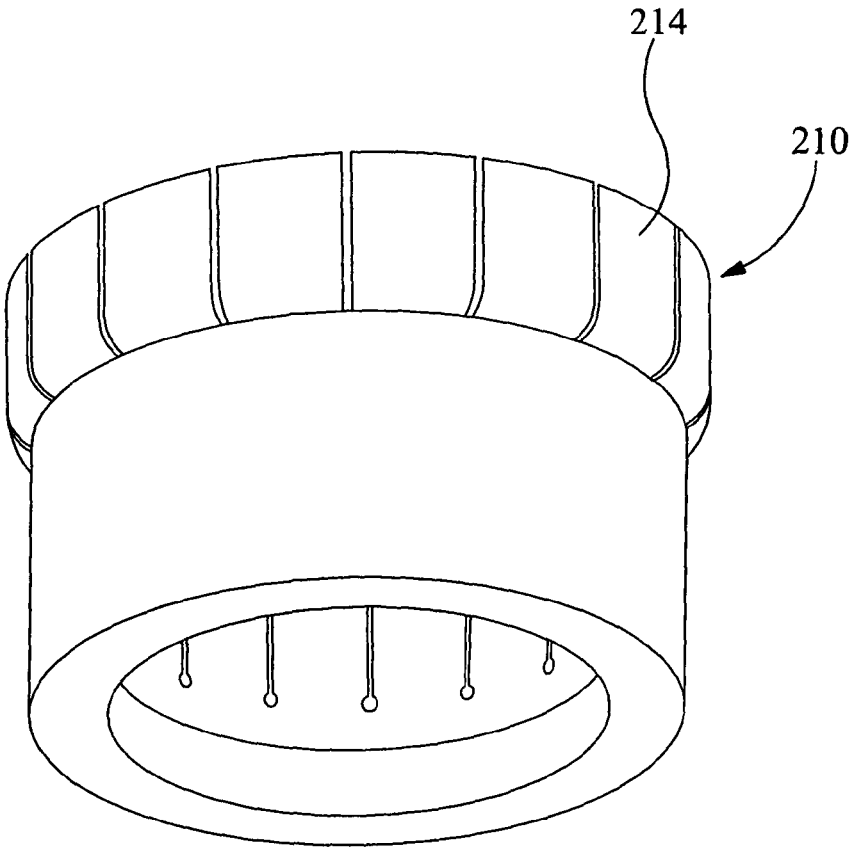
FIG. 12 is a perspective view of the apparatus of FIG. 9 in a set configuration.

The sealing apparatus 10 comprises a sealing element 12 (only shown in FIG. 2 for clarity), the sealing element 12 adapted to be moved from the run-in configuration shown in FIGS. 1, 2 and 3 to a set configuration shown in FIG. 4. The sealing apparatus 10 further comprises a first back-up layer 14, a second back-up layer 16 and a ring member 20. The second back-up layer 16 is sandwiched between the sealing element 12 and the first back-up layer 14.

The second back-up layer 16 is pressed from annealed stainless steel sheet and is 0.5 mm thick. This is considerably thinner than the first back-up layer 14 which is machined from solid bar to a wall thickness of 2 mm. The thinness of the second back-up layer 16 facilitates the expansion of the back-up layers 14,16 as the sealing element 12 moves from the run-in configuration to the set configuration.

As can be seen from FIGS. 1 to 3, an upper portion 22 of the first back-up layer 14 is slotted to form a number of discrete petals 24. The petals 24 permit the first back-up layer 14 to expand as the sealing element 12 moves from the run-in configuration to the set configuration more easily. As the first back-up layer 14 expands, the slots 26 defined by the first back-up upper portion 22 will open up leaving gaps. In the set configuration each of these gaps is filled by a petal 34 defined by the second back-up layer 16. The thinness of the second back-up layer 16 and ductility of the material, permits the second back-up layer 16 to be bent into the gaps formed by the opening of the slots 26 in the first back-up layer 14 ensuring that the back-up layer 14,16, once expanded to the set configuration, make a continuous surface.

Referring particularly to FIGS. 1 and 2, it will be noted that the tips 44 of the second back-up layer petals 34 extend above the tips 42 of the first back-up layer petals and both sets of tips 42,44 are chamfered. The tips 42,44 are chamfered to allow them to deform into engagement with the bore wall and close up any clearances between the apparatus and the bore wall. The second back-up layer tips 44 are of a thinner material than the first back-up layer tips 42 and are therefore more deformable. For this reason the second back-up layer tips 44 extend above the first back-up layer tips 42 to close any clearances between the first back-up layer and the bore wall and any clearances between the first and second back-up layers 14,16 into which the sealing element 12 could extrude.

As can be seen from FIG. 1, the slots 36 between adjacent second back-up layer petals 34 are considerably bigger than those defined in the first back-up layer 14. This design of the second back up layer 16 is such that the petals 34 have sufficient width to fill the gaps between the adjacent petals 24 but are as narrow as possible to assist deformation. The internal surface 38 of the second back-up layer has a low coefficient of friction coating applied to prevent damage to the sealing element 12 as the sealing apparatus 10 sets.

The ring member 20 is provided as a separate component to the back-up layers 14,16. During assembly the back-up layers 14,16 are slid inside the ring member 20. The seal element 12 is bonded to the ring member 20, trapping the back-up layers between the sealing element 12 and the ring member 20.

The ring member 20 defines a profiled surface 40 which the back-up layers 14,16 bend around under the action of the sealing element 12 as the sealing apparatus 10 moves from the set configuration to the run-in configuration. As will be clear from FIG. 3, once assembled, the bottom 39 of the slots 26 will be received within the ring member 20 and will be engaged with the profiled surface 40. The ring member 20, during deployment of the first back-up layer 14, will support the first back-up layer and will help reduce stress concentrations within the first layer 14. The ring member 20 also enables a relatively thin section to be used for the first back-up layer 14 and permits the first back-up layer 14 to be of constant cross-section for the majority of its length reducing the likelihood of stress concentrations forming.

Referring now to FIG. 4, the sealing apparatus 10 is fully expanded and the first back-up layer external surface 28 is engaged with the bore wall 50. The first back-up layer external surface 28 defines a profile having a high coefficient of friction to improve the grip between the apparatus 10 and the bore wall 50. As can be seen, more than 50% of the first back-up layer slotted portion surface 28 is engaged with the bore wall 50. This degree of surface area contact ensures that the friction between the surface 28 and the bore wall 50 is sufficient to resist the axial load applied to the first back-up layer 14 by the well pressure, preventing the first back-up layer from being subjected to shear and bending loads adjacent the ring member tip 80.

As can be seen from FIG. 4, the back-up layers 14,16 have bent around the ring member profile 40 into engagement with the bore wall 50. The second back-up layer petals 34 have filled the openings in the slots 26 of the first back-up layer 14 to provide a continuous surface engaged with the bore wall 50, preventing extrusion of the sealing element (not shown) down the annulus 52 between the apparatus 10 and the bore wall 50.

Reference is now made to FIGS. 5, 6, 7 and 8 which show a sealing apparatus 110 according to a second embodiment of the present invention. The sealing apparatus 110 is a high expansion sealing apparatus for expanding across a larger annulus. In this apparatus, the first back-up layer 114 comprises many more petals 124 than the first back-up layer 14 of the first embodiment. These narrower petals 124 will expand further without imparting excessive stress to the sealing element 112 (shown in FIG. 8). In addition, the use of narrower petal will reduce the size of the gaps between petals once the petals are expanded. As the first back-up layer 14 is the primary structural layer, the use of narrower petals and hence a greater number of slots ensures that the second back-up layers 116 are more evenly supported which in turn means the second back-up layers 116 can be thinner and more flexible.

In the second embodiment, the sealing apparatus 110 comprises two back-up layers 116*a*,116*b*. Each second back-up layer 116*a*,116*b* is pressed from annealed stainless steel sheet. In this embodiment, two back-up layers 116 are required to fill the significant increase in the number of narrower gaps between adjacent petals 124 as the first back-up layer 114 expands. The second back-up layers 116 of this embodiment are thinner than the second back-up layer 16 of the first embodiment to compensate for the additional stiffness which arises by using wider petals 134.

Referring now to FIGS. 9, 10, 11 and 12, these Figures show a sealing apparatus 210 according to a third embodiment of the present invention. The second back-up layer and the sealing element of this embodiment are not shown on the Figures for clarity.

The sealing apparatus 210 is a retrievable apparatus and the first back-up layer 214 is manufactured from spring steel. The first back-up layer 214 is biased towards the run-in configuration shown in FIGS. 9 and 10. The other difference between this and the apparatus of the first embodiment is that the profiled surface 240 of the ring member 220 includes a tapered portion 260 which tapers away from back-up layer 214 in the run-in configuration. As the sealing element expands, the first back-up layer 214 bends around the profiled surface 240 into engagement with the bore wall 250 (shown in FIG. 11). During this expansion, the first back-up layer 214 is deformed within its elastic limit. When the pressure used to set the apparatus 210 is removed the spring steel first back-up layer 214 will recover at least partially to the run-in configuration permitting the apparatus 210 to be recovered to surface.

In addition, the first back-up layer petal tips 242, in the run-in configuration, are bent slightly radially inwards to facilitate recovery to the run-in configuration.

Figure 13:
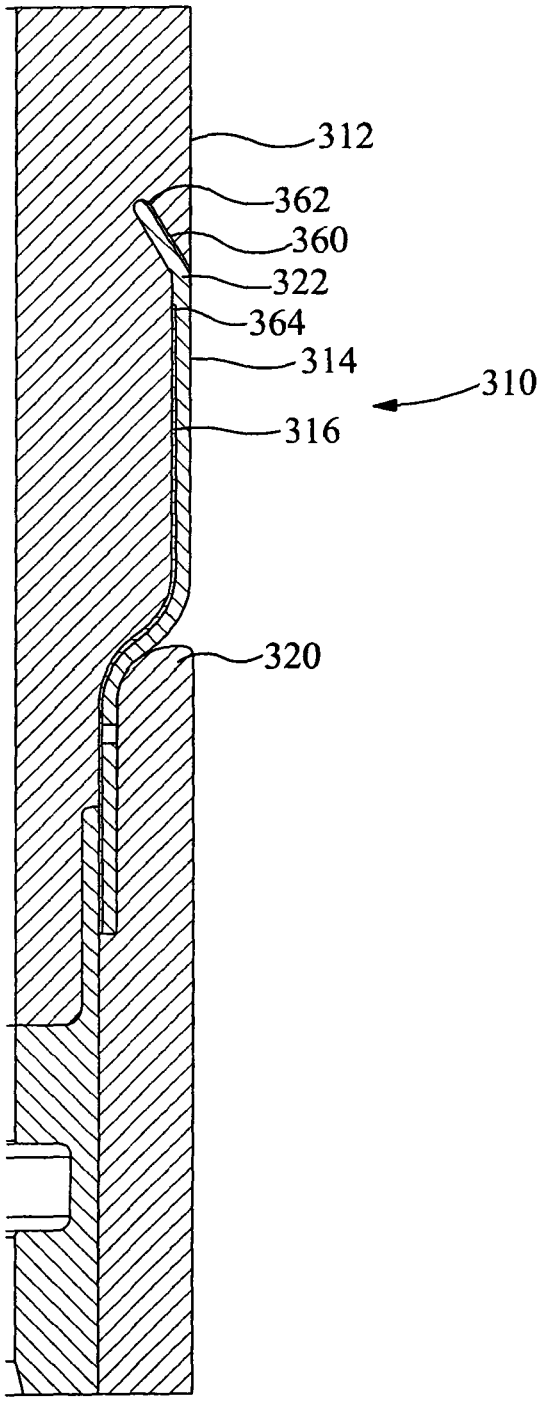
FIG. 13 is a section view of part of a retrievable sealing apparatus according to a fourth embodiment of the present invention.
Figure 14:
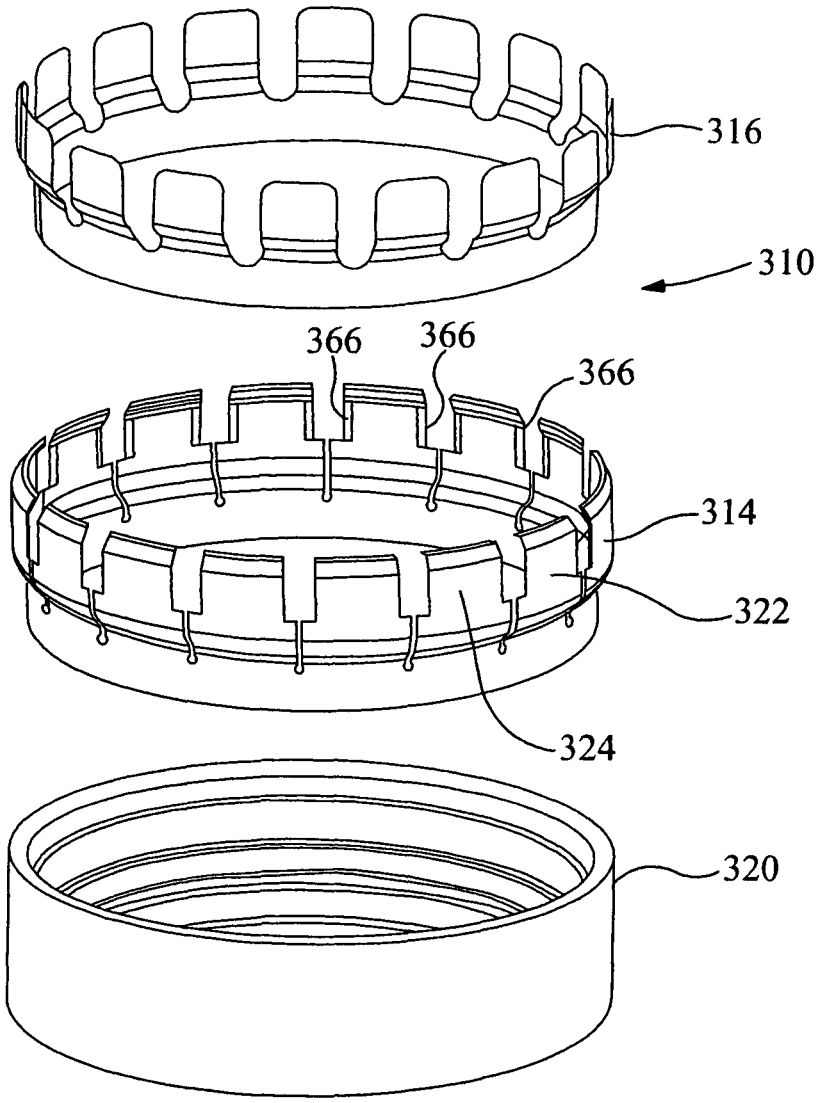
FIG. 14 is an exploded view of the apparatus in FIG. 13.

Reference is now made to FIGS. 13 and 14 which show views of a retrievable sealing apparatus 310 according to a fourth embodiment of the present invention.

The sealing apparatus 310 comprises a sealing element 312, the sealing element 312 adapted to moved from the run-in configuration shown in FIGS. 13 and 14 to a set configuration in which the sealing element 312 is engaged with a conduit wall (not shown). The sealing apparatus 310 further comprises a first back-up layer 314, a second back-up layer 316 and a ring member 320. As can be seen from FIG. 13 in particular, the second back-up layer 316 is considerably thinner than the first back-up layer 314.

Other features of note in this embodiment is the upper portion 322 of the first back-up layer 314 which includes a radially inward facing portion 360. This radially inward facing portion 360 facilitates recovery of the first back up layer 314 from the extended configuration in which the first back-up layer 314 and the sealing element 312 are in contact with the conduit wall to the run-in configuration shown in FIG. 13, in which the maximum external diameter of the first back-up layer 314 and the seal element 312 is less than the maximum external diameter of the ring member 320 permitting the sealing apparatus 310 to be recovered from a downhole location. Even in the extended configuration (not shown), the diameter defined by the tip 362 of the first back-up layer 314 is less than the maximum external diameter of the ring member 320.

It will also be noted that the first back-up layer 314 extends above an upper edge 364 of the second back-up layer 316. To ensure tight fit between the first and second back-up layers 314, 316 and to eliminate any extrusion gaps, the side edges 366 (FIG. 14) of the petals 324 are chamfered. As the side edges are partly concealed, if the gap between adjacent petals 324 is small enough, the petal chamfered side edges 366 can be relatively sharp facilitating a better fit, and consequently reduced gaps, between the first and second back-up layers 314, 316 in the extended configuration. The second back-up layer 316 can better mould around a sharp edge as provided for by the chamfered side edge 366.

Figure 15:
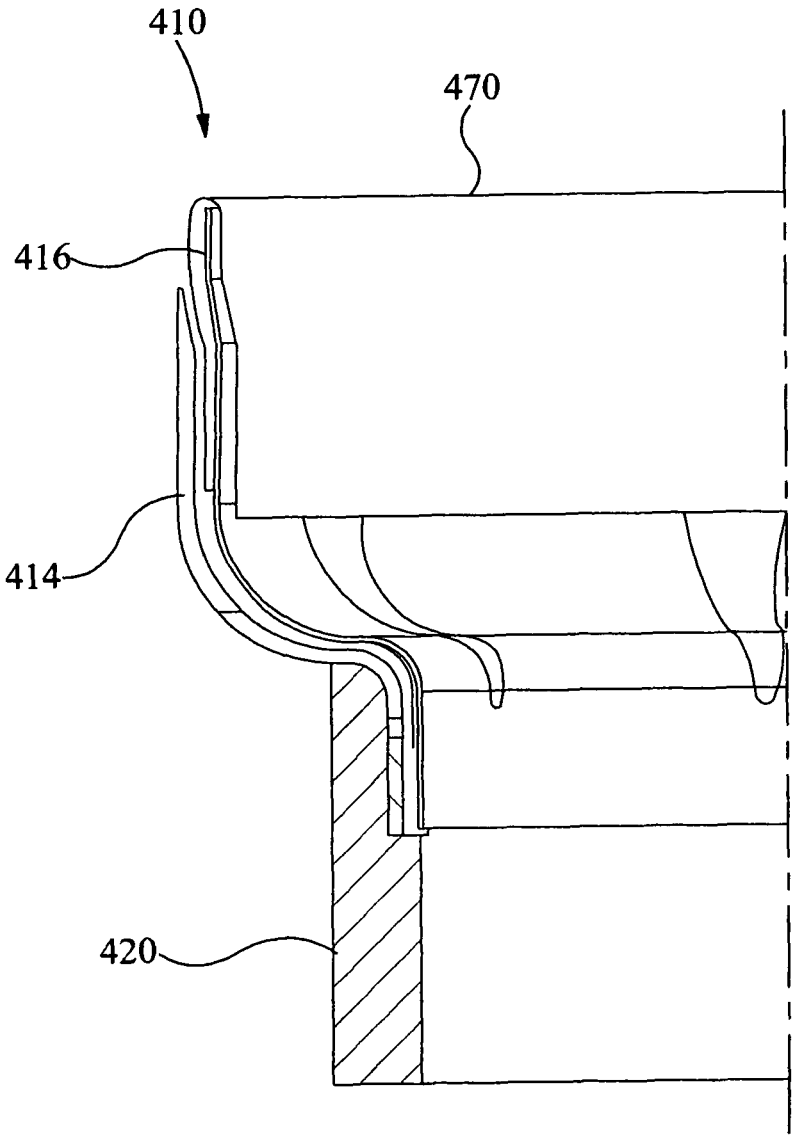
FIG. 15 is a section view through part of a sealing apparatus according to a fifth embodiment of the present invention.

Referring finally to FIG. 15, this figure shows a section view of part of a sealing apparatus 410 according to a fifth embodiment of the present invention. This sealing apparatus 410 includes a sealing element (not shown) similar to the sealing element 12 of the first embodiment, a first back-up layer 414, a second back-up layer 416 and a ring member 420. The sealing apparatus 410 further comprises an intermediate layer 470 which is sandwiched between the first and second back-up layers 414, 416 and wraps over the top of and down the inside of the second back-up layer 416.

The intermediate layer 470 is a woven steel mesh and is made from a sheet which is formed into a sleeve and spot welded to the first back-up layer 414. As the sealing apparatus 410 expands from the run-in configuration (not shown) to the set configuration (shown in FIG. 14) the intermediate layer 470 moulds itself into any remaining extrusion gaps between the first and second back-up layers 414, 416 providing an extremely reliable back-up to the sealing element.

Various modifications and improvements can be made to the above described embodiment without departing from the scope of the present invention. For example, for low expansion environments it is not necessary to have the first and/or second back-up layers slotted, continuous banded material could be used. In an alternative embodiment, where there are two second back-up layers used, the tips of the inner back-up layer could extend above the tips of the outer back-up layer, which in turn extend above the tips of the first back-up layer. This further facilitates the closing of any gaps or clearances between the apparatus and the well bore surface.

The invention claimed is:

1. A sealing apparatus for sealing a well bore, the sealing apparatus comprising:

a ring member;

an annular seal element adapted to move from a run-in configuration to a set configuration, wherein a portion of the seal element is received in the ring member radially inward from the ring member;

at least one continuous annular back-up layer radially between the seal element and the ring member, the at least one continuous annular back-up layer being adapted to be moved from the run-in configuration to the set configuration under the action of the sealing element, wherein in the run-in configuration the maximum diameter defined by the at least one continuous back-up layer is no more than the maximum diameter defined by the ring member and in the set configuration the at least one continuous back-up layer is radially expanded relative to the maximum diameter defined by the ring member, and wherein a portion of the at least one continuous annular back-up layer is received inside the ring member, the ring member and the at least one back-up layer being separate components.

2. The sealing apparatus of claim 1, wherein the at least one continuous annular backup-layer comprise a first and a second annular back-up layer.

3. The sealing apparatus of claim 2, wherein the first back-up layer comprises a slotted portion.

4. The sealing apparatus of claim 3, wherein the first back-up layer is slotted to form discrete petals.

5. The sealing apparatus of claim 3, wherein the first back-up layer comprises a non-slotted portion.

6. The sealing apparatus of claim 1, wherein the at least one continuous annular back-up layer comprises a deformable material.

7. The sealing apparatus of claim 6, wherein the deformable material is ductile.

8. The sealing apparatus of claim 1, wherein in use, the at least one continuous annular back-up layer, in the run-in configuration, is adapted to engage the bore wall.

9. The sealing apparatus of claim 1, wherein the at least one continuous annular back-up layer comprises a bore engaging surface.

10. The sealing apparatus of claim 9, wherein in use, more than 50% of the bore engaging surface is, in use, engaged with the bore surface in the set configuration.

11. The sealing apparatus of claim 9, wherein the at least one continuous annular back-up layer comprises a slotted portion and wherein, in use, more than 50% of the slotted portion surface is engaged with the bore surface in the set configuration.

12. The sealing apparatus of claim 9, wherein the bore engaging surface comprises relatively high friction co-efficient.

13. The sealing apparatus of claim 12, wherein the bore engaging surface defines a relatively high friction co-efficient surface profile.

14. The sealing apparatus of claim 1, wherein at least one continuous annular back-up layer is a ductile material.

15. The sealing apparatus of claim 14, wherein the ductile material is stainless steel.

16. The sealing apparatus of claim 1, wherein the at least one continuous annular back-up layer has an upper edge.

17. The sealing apparatus of claim 16, wherein the upper edge is chamfered.

18. The sealing apparatus of claim 17, wherein the upper edge, in use, is chamfered towards the bore wall.

19. The sealing apparatus of claim 4, wherein where the at least one continuous annular back-up layer defines discrete petals, each petal has side edges.

20. The sealing apparatus of claim 1, wherein the at least one continuous annular back-up layer includes at least one second back up layer having an upper edge that is chamfered.

21. The sealing apparatus of claim 20, wherein the at least one second back-up layer upper edge extends above a first back-up layer upper edge of the at least one continuous annular backup layer.

22. The sealing apparatus of claim 1, wherein at least one continuous annular back-up layer has a sealing element engaging surface.

23. The sealing apparatus of claim 22, wherein the/each sealing element engaging surface comprises a low friction coating.

24. The sealing apparatus of claim 1, wherein the at least one continuous annular back-up layer deforms under the action of the sealing element.

25. The sealing apparatus of claim 24, wherein the at least one continuous annular back-up layer plastically deforms.

26. The sealing apparatus of claim 1, wherein the ring member is attached to a lower portion of the at least one continuous annular back-up layer.

27. The sealing apparatus of claim 1, wherein the ring member is separate to at least one continuous annular back-up layer.

28. The sealing apparatus of claim 26, wherein the back-up layer lower portion is received within the ring member.

29. The sealing apparatus of claim 5, wherein the ring member is attached to the non-slotted portion of the first back-up layer.

30. The sealing apparatus of claim 5, wherein the interface between the slotted and non-slotted portions of the first back-up layer is received within the ring member.

31. The sealing apparatus of claim 1, wherein the ring member is connected to an external surface of a lower portion of a first back-up layer of the at least one continuous annular back-up layer.

32. The sealing apparatus of claim 1, wherein the/each second back-up layer is connected to the ring member.

33. The sealing apparatus of claim 1, wherein the ring member defines a profiled surface.

34. The sealing apparatus of claim 33, wherein as the sealing apparatus moves from the run-in configuration to the set configuration, a first back-up layer bends around at least a portion of the profiled surface.

35. The sealing apparatus of either of claim 33 or 34, wherein at least a portion of the first back-up layer, in the run-in configuration is displaced from the ring member profiled surface.

36. A sealing apparatus for sealing a well bore, the sealing apparatus comprising:

a ring member;

an annular seal element adapted to be moved from a run-in configuration to a set configuration, wherein a portion of the seal element is received in the ring member radially inward from the ring member; and at least continuous annular back-up layer radially between the sealing element and the ring member, the at least one back-up layer being adapted to be moved from the run-in configuration to the set configuration under the action of the sealing element, wherein in the run-in configuration, the maximum diameter defined by the at least one continuous back-up layers is no more than the maximum diameter defined by the ring member and in the set configuration the at least one continuous back-up layer is radially expanded relative to the maximum diameter defined by the ring member, and wherein at least one of said continuous annular back-up layers comprises a resilient material, said resilient material being biased to the run-in configuration.

* * * * *